US009478892B2

(12) United States Patent
Scanzillo et al.

(10) Patent No.: US 9,478,892 B2
(45) Date of Patent: Oct. 25, 2016

(54) TAMPER-RESISTANT ASSEMBLY WITH WEAR-RESISTANT SHUTTERS

(71) Applicant: Hubbell Incorporated, Shelton, CT (US)

(72) Inventors: Thomas L Scanzillo, Monroe, CT (US); Edward Bazayev, Kew Gardens, NY (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/466,393

(22) Filed: Aug. 22, 2014

(65) Prior Publication Data

US 2015/0064944 A1 Mar. 5, 2015

Related U.S. Application Data

(60) Provisional application No. 61/871,723, filed on Aug. 29, 2013.

(51) Int. Cl.

| | |
|---|---|
| ***H01R 13/44*** | (2006.01) |
| ***H01R 13/453*** | (2006.01) |
| *H01R 103/00* | (2006.01) |
| *H01R 24/78* | (2011.01) |
| *H01R 25/00* | (2006.01) |

(52) U.S. Cl.

CPC ..... *H01R 13/4534* (2013.01); *H01R 24/78* (2013.01); *H01R 25/006* (2013.01); *H01R 2103/00* (2013.01)

(58) Field of Classification Search

CPC ..... H01R 13/4534; H01R 2103/00; H01R 24/78

USPC ..... 439/137

See application file for complete search history.

(56) References Cited

U.S. PATENT DOCUMENTS

| | | | | |
|---|---|---|---|---|
| 4,544,219 | A | 10/1985 | Barkas | |
| 4,722,693 | A | 2/1988 | Rose | |
| 4,780,793 | A | 10/1988 | Ohtsuki | |
| 5,006,075 | A | 4/1991 | Bowden, Jr. | |
| 5,915,981 | A | 6/1999 | Mehta | |
| 6,299,487 | B1 | 10/2001 | Lopata et al. | |
| 6,749,449 | B2 | 6/2004 | Mortun et al. | |
| 6,893,275 | B2 | 5/2005 | Ng et al. | |
| 7,090,520 | B2 | 8/2006 | Matsukawa et al. | |
| 7,510,412 | B1 * | 3/2009 | Valentin | H01R 13/4534 439/137 |
| 7,637,756 | B1 | 12/2009 | Hsu | |
| 7,868,719 | B2 * | 1/2011 | Bazayev | H01H 9/0264 200/43.16 |
| 8,353,711 | B2 | 1/2013 | Huang et al. | |
| 2011/0229094 | A1 | 9/2011 | Isenhour et al. | |

FOREIGN PATENT DOCUMENTS

| | | | |
|---|---|---|---|
| CA | 2650745 | A1 | 8/2009 |

* cited by examiner

*Primary Examiner* — Abdullah Riyami
*Assistant Examiner* — Nelson R Burgos-Guntin
(74) *Attorney, Agent, or Firm* — Dickinson Wright PLLC

(57) ABSTRACT

A tamper-resistant assembly for an electrical device, such as an electrical receptacle, includes a housing enclosing movable shutter members, each having a ramped surface protected by an overlying winged cover member engageable by an object, such as a plug blade, inserted in an opening in the electrical device. Each shutter member has a pair of pockets on opposite sides of the ramped surface that anchor the wings of the cover member. The pockets extend laterally outward from the sides of the ramped surface, and the wings of the cover member are configured such that they flex inward during assembly and then snap into the pockets. Other mating features of the cover member and the shutter member help ensure secure anchoring of the cover member.

20 Claims, 6 Drawing Sheets

TAMPER-RESISTANT ASSEMBLY WITH WEAR-RESISTANT SHUTTERS

CROSS-REFERENCE TO RELATED APPLICATION

This application claims the benefit of provisional application No. 61/871,723, filed Aug. 29, 2013, which is incorporated herein by reference in its entirety.

FIELD OF THE INVENTION

The present invention relates generally to a shutter member of a tamper-resistant assembly of an electrical wiring device. More particularly, the present invention relates to a cover member for a shutter member of an electrical wiring device. Still more particularly, the present invention relates to a shutter member having pockets to receive tabs of a cover member to secure the cover member to the shutter member.

BACKGROUND OF THE INVENTION

Shutter assemblies are disposed in electrical wiring devices to prevent accidental insertion of an object into an electrically energized portion of the electrical wiring device. A ramped surface of a first shutter member overlies a blocking portion of a second shutter member. An inserted object contacts the ramped surface of the first shutter member, thereby sliding the first shutter member out of the way. The inserted object is prevented from accessing the energized contact by the blocking portion of the second shutter member. Accordingly, two objects must be inserted to defeat the shutter members of the shutter assembly to access the electrical contacts.

Inserting two objects, such as the blades of a plug, contacts the two ramped surfaces of the two shutter members, thereby causing both shutter members to slide. The two blades of the inserted plug then can engage the electrical contacts disposed behind the shutter assembly. After repeated plug insertions, the ramped surfaces of the shutter members, which are usually molded of plastic, can become gouged or otherwise marred. Such damage can cause the shutter members to fail to operate upon insertion of a plug, such that the plug cannot be electrically connected to the electrical contacts of the electrical wiring device.

While protective shutter covers are known in the prior art, they typically are complex and complicate assembly of the device in which they are installed. Accordingly, a need exists for a simple, easy-to-install cover member for protecting the shutters of a tamper-resistant assembly of an electrical wiring device.

SUMMARY OF THE INVENTION

A tamper-resistant assembly for an electrical device according to the invention includes a housing, at least one shutter member having a ramped surface and movably mounted in a housing, and a cover member connected to the shutter member and overlying and protecting the ramped surface from an object inserted in an opening in the electrical device. The shutter member has a pair of pockets on opposite sides of the ramped surface. The cover member has a central portion and a pair of laterally extending wings on opposite sides of the central portion anchored in the pockets.

The pockets in the shutter member preferably extend laterally outward from the sides of the ramped surface. The wings of the cover member preferably are configured such that they flex inward during assembly and then snap into the pockets. Other mating features of the cover member and the shutter member help ensure that the cover member remains securely anchored during use of the electrical device.

The invention also is directed to a tamper-resistant electrical receptacle that incorporates the aforementioned tamper-resistant assembly. The assembly preferably has a pair of shutter members that move in opposite directions, and each shutter member has a cover member as described above.

BRIEF DESCRIPTION OF THE DRAWINGS

A preferred embodiment of the disclosed invention is described in detail below purely as an example, with reference to the accompanying drawing, in which.

Throughout the drawings, like reference numerals will be understood to refer to like parts, components and structures.

DETAILED DESCRIPTION OF EXEMPLARY EMBODIMENT

As used in this application, the terms "front," "rear," "upper," "lower," "upwardly," "downwardly," and other orientative descriptors are intended to facilitate the description of the exemplary embodiments of the present invention, and are not intended to limit the structure thereof to any particular position or orientation.

Figure 7:
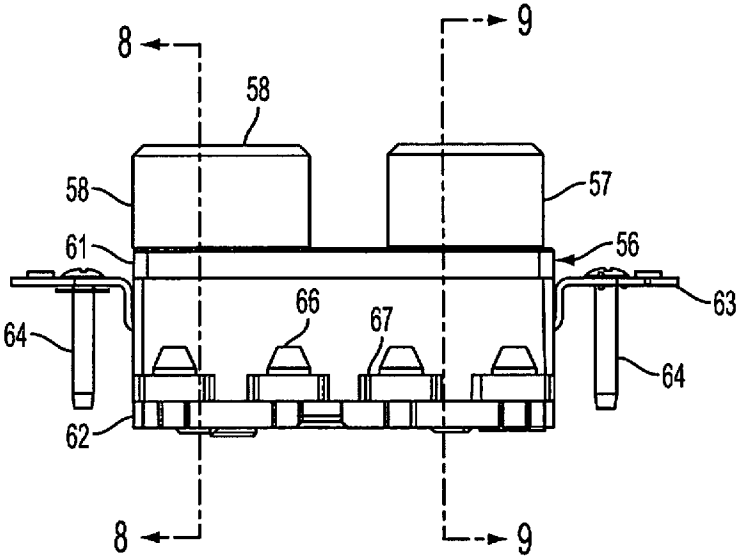
FIG. 7 is a side elevational view of the electrical wiring device of FIG. 1 after insertion of an electrical plug therein.
Figure 12:
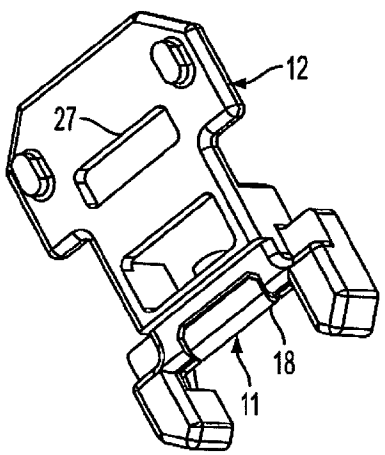
FIG. 12 is a lower perspective view of the cover member connected to the first shutter member of FIG. 10.
Figure 13:
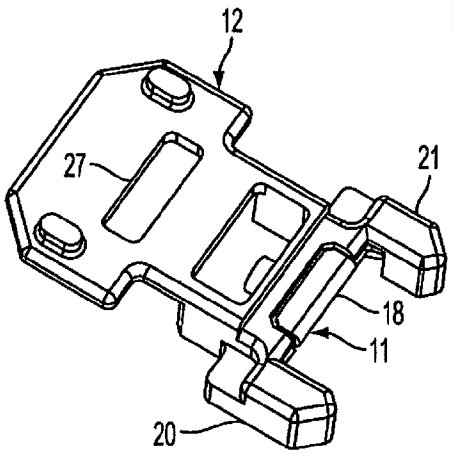
FIG. 13 is another lower perspective view of the cover member connected to the first shutter member of FIG. 10.
Figure 11:
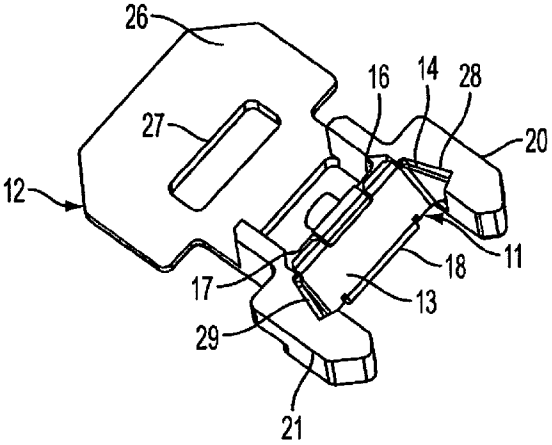
FIG. 11 is a perspective view of the cover member connected to the first shutter member of FIG. 10.

The present invention generally relates to a cover member 11 securable to a shutter member of a tamper-resistant assembly 55 of an electrical wiring device 56, as shown in FIGS. 1-17. First and second shutter members 12 and 41 in accordance with an exemplary embodiment of the present invention, as shown FIGS. 1-4, can be used with any suitable electrical wiring device, such as a combination 15 and 20 amp electrical receptacle 56 as shown in FIGS. 1, 2 and 4-9. The tamper-resistant assembly 55 provides tamper resistance for the electrical wiring device 56 adapted to receive both 15 and 20 amp plugs 57 and 58, as shown in FIGS. 4 and 7.

Figure 3:
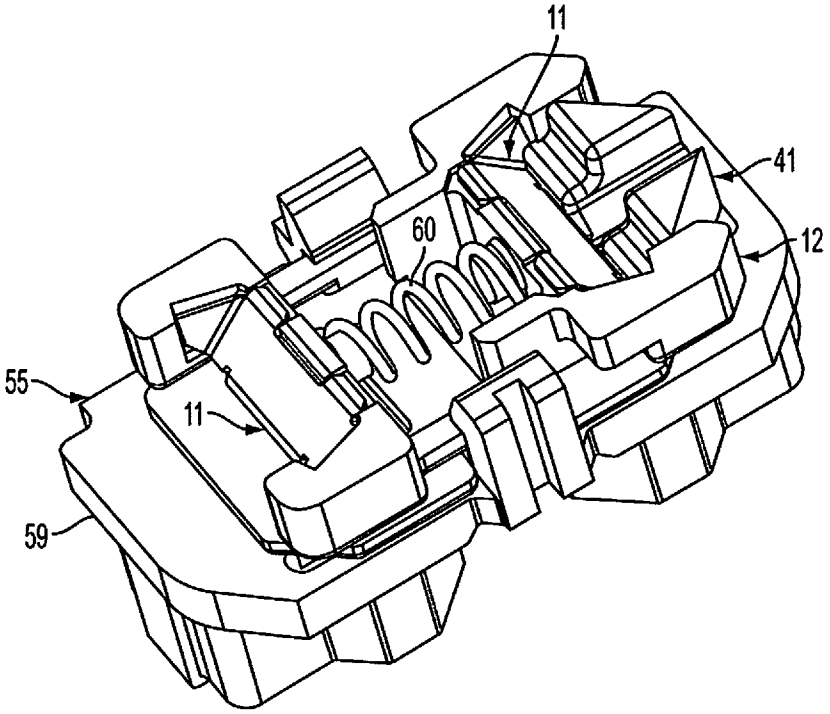
FIG. 3 is a perspective view of the tamper-resistant assembly of FIG. 1.
Figure 5:
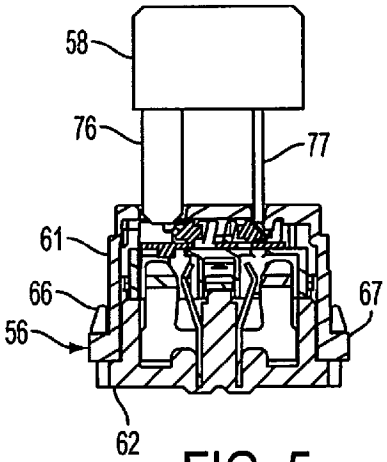
FIG. 5 is an end elevational view in cross section taken along line 5-5 of FIG. 4.
Figure 6:
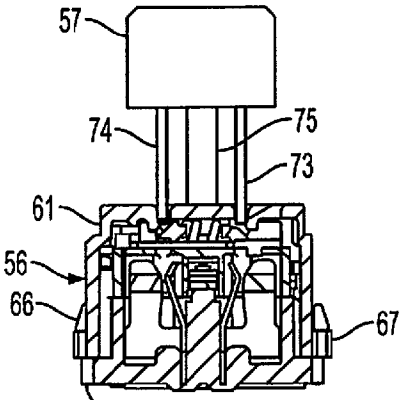
FIG. 6 is an end elevational view in cross section taken along line 6-6 of FIG. 4.
Figure 4:
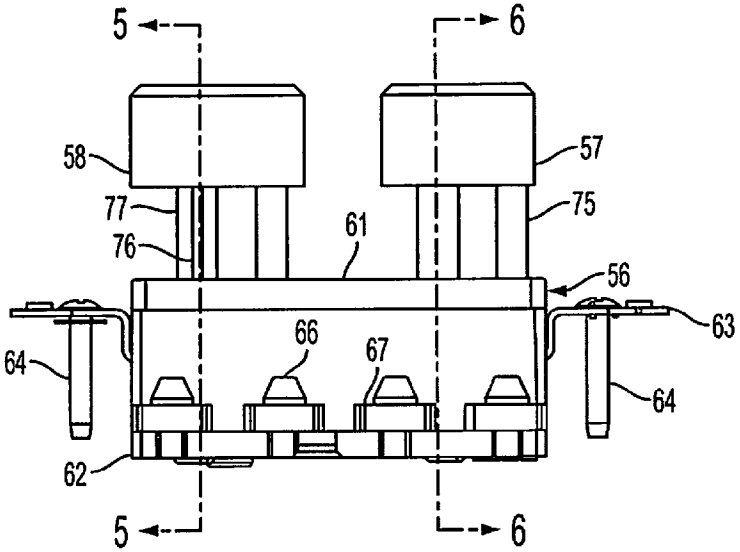
FIG. 4 is a side elevational view of the electrical wiring device of FIG. 1 prior to insertion of an electrical plug therein.

The tamper-resistant assembly 55, as shown in FIG. 3, includes a base member 59, the first shutter member 12, the second shutter member 41 and a spring 60. The first shutter member 51 is slidably connected to the base member 41.

Figure 1:
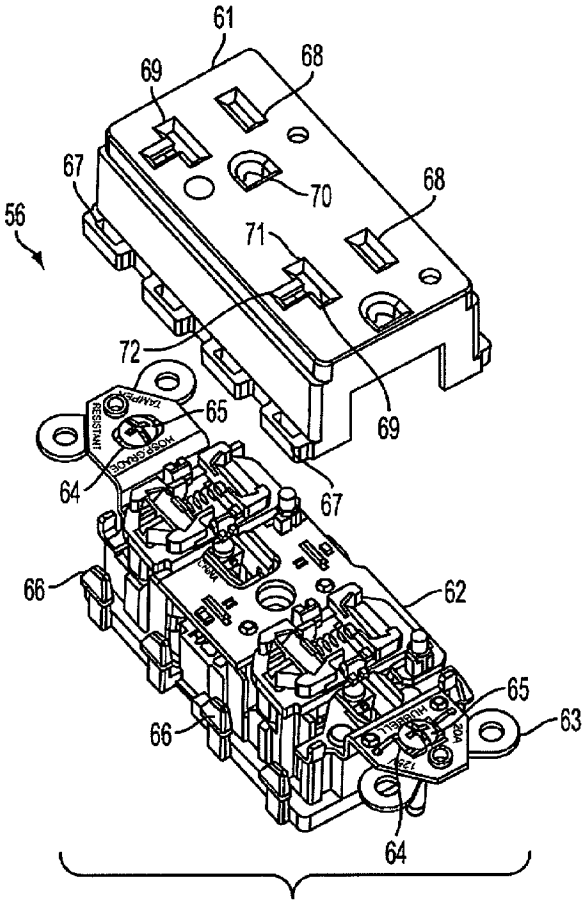
FIG. 1 is a perspective view of an electrical wiring device with a cover removed and receiving a tamper-resistant assembly in accordance with an exemplary embodiment of the present invention.
Figure 8:
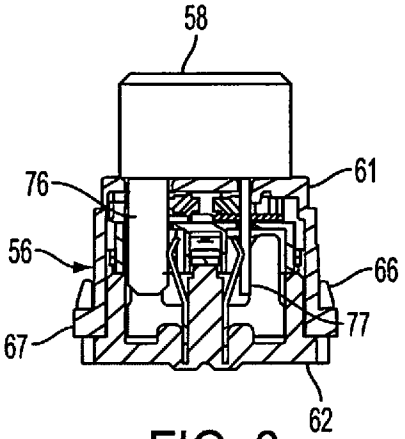
FIG. 8 is an end elevational view in cross section taken along line 8-8 of FIG. 7.

The electrical receptacle 56 has a front cover 61 connected to a back housing 62 with a ground strap 63 connected thereto, as shown in FIG. 1. The ground strap 63 has openings 64 disposed at opposite ends adapted to receive fasteners 65 to connect the electrical receptacle 56 to an electrical box (not shown). The ground strap 63 may extend around a rear surface of the back housing or may, alternatively, be disposed between the front cover and the back housing. A plurality of arms 66 extend forwardly from the back housing 62 and are received by receptacles 67 of the front cover 61 to connect the front cover to the back housing. Conductive elements are disposed within the back housing 62 to receive and make electrical contact with inserted blades of an electrical plug, as shown in FIGS. 8 and 9.

Figure 2:
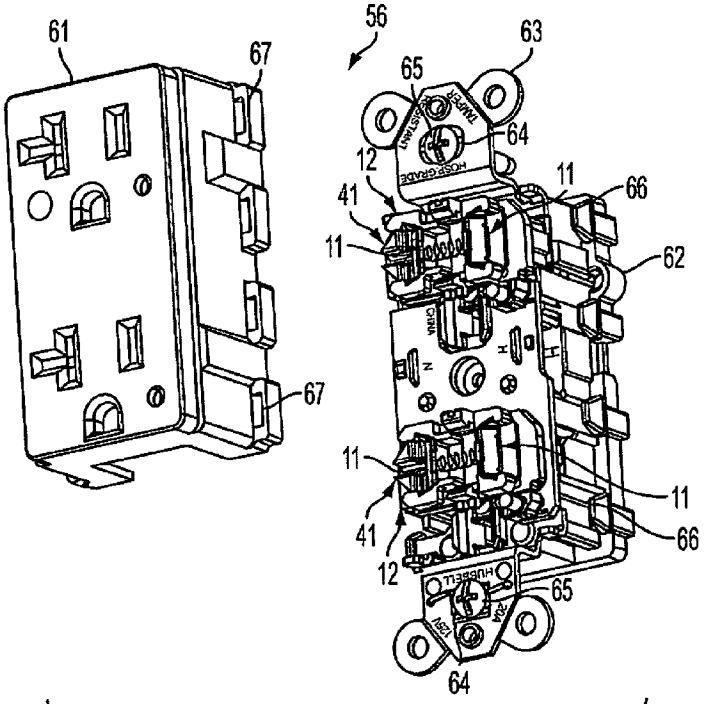
FIG. 2 is another perspective view of the electrical wiring device of FIG. 1.

The front cover 61 has openings suitably disposed to receive the prongs and blades of a conventional male plug. The electrical receptacle 56 shown in FIGS. 1 and 2 is a duplex electrical receptacle, although the present invention is not limited thereto. A first opening 68 and a second opening 69 are disposed in the front cover 61 to receive the blades that form part of the power circuit for the appliance being connected thereto. A third opening 70 receives the ground prong of a grounded three-prong connector. The first opening 68 is substantially rectangular in shape and the second opening 69 is substantially T-shaped. The second opening 69 may receive a plug blade that is either substantially parallel to the blade passing through the first opening 68 as shown in FIG. 9, or that is substantially perpendicular to the blade passing through the first opening 68 as shown in FIG. 8. The second opening 69 has a first portion 71 substantially parallel to the first opening 68 and a second portion 72 substantially perpendicular to the first opening 68 (as well as being substantially perpendicular to the first portion 71 of the second opening 69).

Figure 9:
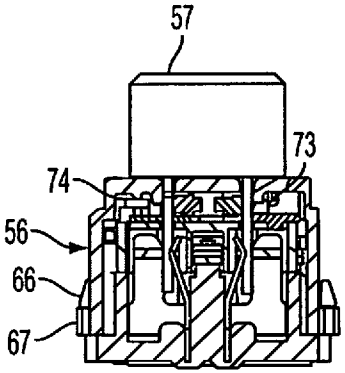
FIG. 9 is an end elevational view in cross section taken along line 9-9 of FIG. 7.

A plug 57 in which the two blades 73 and 74 passing through the first and second openings 68 and 69 are substantially parallel is referred to as a parallel blade plug, such as a 15 amp plug shown in FIGS. 7 and 9. A plug 58 that has the blade 76 passing through the second opening 69 disposed in a plane substantially perpendicular to the plane in which the blade 77 passing through the first opening 68 is an orthogonal blade plug, such as a 20 amp plug shown in FIGS. 7 and 8. The ground prong 75 (FIGS. 4 and 6) is typically substantially D-shaped in cross-section, and is generally longer than the blades passing through the first and second openings 68 and 69. However, the tamper-resistant assembly 55 shown and described does not interfere with the presence of such a grounding plug.

Operation of the first and second shutter members 12 and 41 in the tamper-resistant assembly 55 and a more detailed description of the tamper-resistant assembly 55 and the electrical wiring device 56 is described in U.S. Pat. No. 7,510,412 to Valentin, which is incorporated by reference herein in its entirety.

As shown in FIGS. 1-3, 10 and 14, each cover member 11 includes a substantially planar surface 13 and wings 14, 15 that extend laterally outward from opposite sides of the planar surface 13. Preferably, an obtuse angle is formed between the wings 14 and 15 and the planar surface 13. Tabs 16 and 17 extend from an upper side of the planar surface 13. A hook member 18 extends from a lower side of the planar surface 13.

Figure 10:
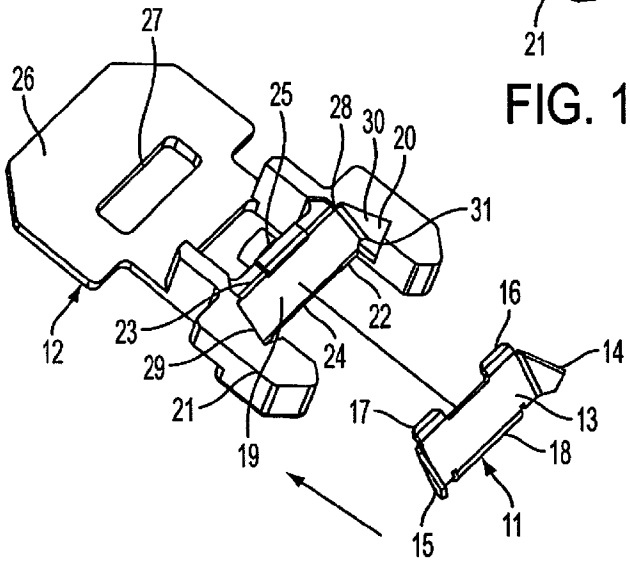
FIG. 10 is an exploded perspective view of a first shutter member and a cover member of FIG. 1.
Figure 16:
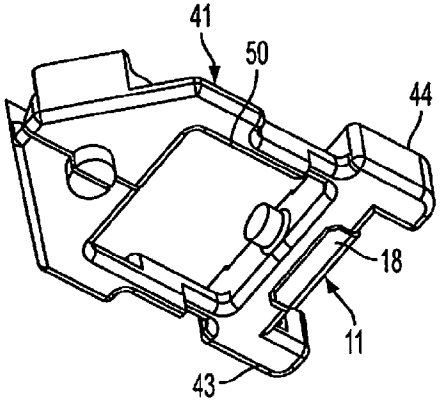
FIG. 16 is a lower perspective view of the cover member connected to the second shutter member of FIG. 14.
Figure 17:
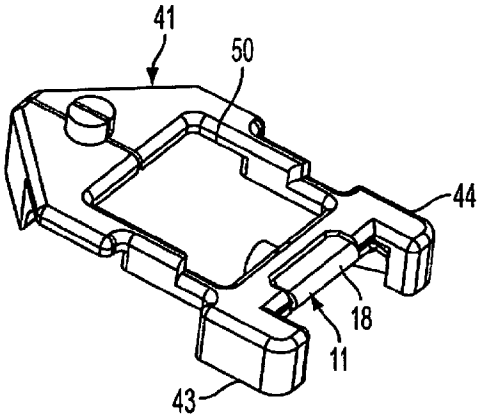
FIG. 17 is another lower perspective view of the cover member connected to the second shutter member of FIG. 14.
Figure 15:
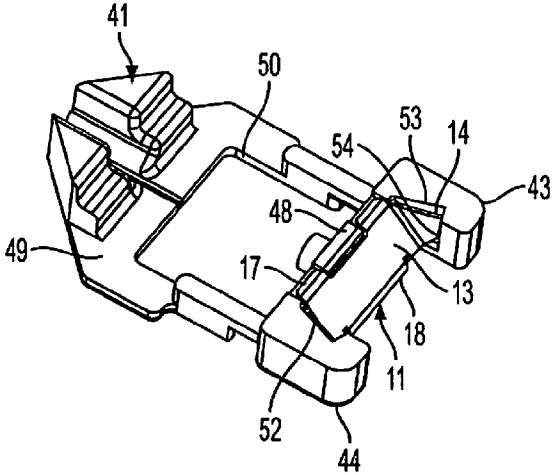
FIG. 15 is perspective view of the cover member connected to the second shutter member of FIG. 4.

As best seen in FIG. 10, the first shutter member 12 includes a ramped surface 19 disposed between two arms 20 and 21. The ramped surface 19 extends from a lower surface 22 to an upper surface 23. A recess 24 is formed in the lower surface 22 and a protrusion 25 is disposed on the upper surface 23. A blocking portion 26 is formed rearward of the ramped surface 19. An aperture 27 in the blocking portion 26 receives a second blade of an electrical plug when the first shutter member 12 is moved by a first blade of the electrical plug.

Pockets 28 and 29 are disposed in the arms 20 and 21 of the first shutter member 12. As seen in FIG. 10, the pockets 28 and 29 extend forwardly and laterally outward from opposite edges of the ramped surface 19. Each pocket thus has a side surface 30 and an end surface 31. Wings 14 and 15 of cover member 11 conform to the side surfaces 30 of their respective pockets 28 and 29.

To connect the cover member 11 to the first shutter member 12, the cover member 11 is moved rearward toward the ramped surface 19, as indicated by the arrow in FIG. 10. The distance between the distal ends of the wings 14 and 15 is greater than the maximum distance between the side surfaces 30 of the pockets 28 and 29, such that the arms 20, 21 cause the wings to flex inwardly until they snap into the pockets 28 and 29. At this point, an inner surface of the cover member's planar surface 13 is disposed adjacent the ramped surface 19; the tabs 16 and 17 are disposed on opposite sides of the protrusion 25; the upper edge 32 of the planar surface 13 (between the tabs 16 and 17) contacts the protrusion 25, thereby preventing further rearward movement of the cover member 11; and the hook member 18 is received in the recess 24 in the lower surface 22, also preventing further rearward movement of the cover member 11. Also, the trailing edges of the wings 14 and 15 engage the end surfaces 31 of the pockets 28 and 29, thereby preventing forward movement of the cover member 11. The cover member 11 thus is securely connected to the first shutter member 12 and is prevented from independent movement when an inserted object strikes its planar surface 13, thereby protecting the shutter member's ramped surface 19 from being marred by the insertion.

Figure 14:
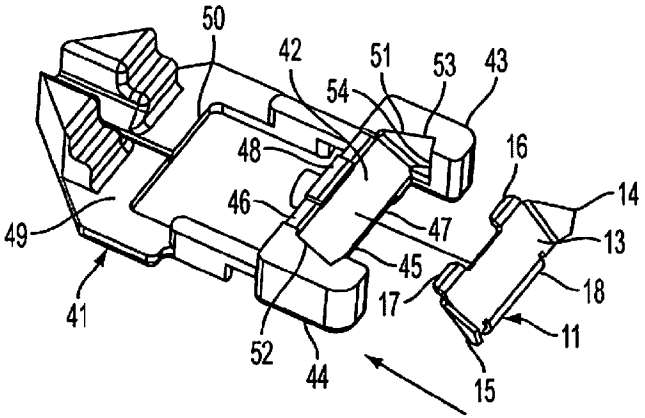
FIG. 14 is an exploded perspective view of a second shutter member and a cover member of FIG. 1.

As best seen in FIG. 14, the second shutter member 41 includes a ramped surface 42 disposed between two arms 43 and 44. The ramped surface 42 extends from a lower surface 45 to an upper surface 46. A recess 47 is formed in the lower surface 45 and a protrusion 48 is disposed on the upper surface 46. A blocking portion 49 is formed rearward of the ramped surface 42. An aperture 50 in the blocking portion 49 receives a second blade of an electrical plug when the second shutter member 12 is moved by a first blade of the electrical plug.

Pockets 51 and 52 are disposed in the arms 43 and 44 of the second shutter member 41. As seen in FIG. 14, the pockets 51 and 52 extend forwardly and laterally outward from opposite edges of the ramped surface 42. Each pocket has a side surface 53 and an end surface 54. A cover member 11 is connected to the second shutter member 41 in a substantially similar manner as the first shutter member 12.

The first and second shutter members 12 and 41 are preferably made of a thermoplastic, such as nylon or acetal. More preferably, a glass-filled nylon is used to increase the structural strength and rigidity of the manufactured parts. The cover member 11 is preferably made of a metal, such as stainless steel or spring steel, although any suitable material can be used. Preferably, the cover member material is harder and more scratch resistant than the shutter member material to withstand repeated insertions without substantially marring or otherwise damaging the cover member and affecting operability thereof.

The foregoing preferred embodiment, its description and its mentioned advantages are merely illustrative and are not to be construed as limiting the scope of the present invention. Various modifications, alternatives and variations will be apparent to those of ordinary skill in the art, and are intended to fall within the scope of the invention as defined by the appended claims and their equivalents.

What is claimed is:

1. A tamper-resistant assembly for an electrical device, comprising:

a housing;

at least one shutter member movably mounted in said housing, said shutter member having a ramped surface and a pair of pockets on opposite sides of said ramped surface, each pocket having a respective side surface and end surface; and a cover member connected to said at least one shutter member and overlying and protecting said ramped surface from an object inserted in an opening in the electrical device, said cover member having a central portion and a pair of laterally extending wings on opposite sides of said central portion forming an obtuse angle with the central portion, each of said wings conforming to the respective side surface of the pockets, and anchored in a respective one of said pockets.

2. The tamper-resistant assembly of claim 1, wherein said shutter member has a recess adjacent a lower edge of said ramped surface, and a lower edge of said cover member has a hook member received in said recess.

3. The tamper-resistant assembly of claim 2, wherein said shutter member has at least one protrusion adjacent an upper edge of said ramped surface, and an upper edge of said cover member abuts said at least one protrusion.

4. The tamper-resistant assembly of claim 1, wherein said pockets extend laterally outward from the sides of said ramped surface.

5. The tamper-resistant assembly of claim 4, wherein said shutter member has a recess adjacent a lower edge of said ramped surface, and a lower edge of said cover member has a hook member received in said recess.

6. The tamper-resistant assembly of claim 5, wherein said shutter member has at least one protrusion adjacent an upper edge of said ramped surface, and an upper edge of said cover member abuts said at least one protrusion.

7. The tamper-resistant assembly of claim 4, wherein prior to connecting said cover member to said shutter member, distal ends of said wings are spaced apart by a first distance that is greater than a maximum distance between inwardly facing side surfaces of said pockets, and when connecting said cover member to said shutter member, said wings flex inward as they enter said pockets.

8. The tamper-resistant assembly of claim 7, wherein said shutter member has a recess adjacent a lower edge of said ramped surface, and a lower edge of said cover member has a hook member received in said recess when said wings are anchored in said pockets.

9. The tamper-resistant assembly of claim 8, wherein said shutter member has at least one protrusion adjacent an upper edge of said ramped surface, and an upper edge of said cover member abuts said at least one protrusion when said wings are anchored in said pockets.

10. The tamper-resistant assembly of claim 7, wherein said wings conform to said inwardly facing side surfaces of their respective pockets and snap into said pockets when fully received therein.

11. A tamper-resistant electrical receptacle, comprising:

a housing;

a pair of electrical contacts in said housing;

a pair of external openings in said housing, said contacts being accessible through respective ones of said openings by respective blades of an inserted electrical plug;

a pair of shutter members movably mounted in said housing between respective ones of said contacts and respective ones of said openings, each shutter member having a ramped surface and a pair of pockets on opposite sides of said ramped surface, each pocket having a respective side surface and end surface; and a pair of cover members, each cover member connected to a respective one of said shutter members and overlying and protecting said ramped surface from a plug blade inserted in said opening, each of said cover members having a central portion and a pair of laterally extending wings on opposite sides of said central portion forming an obtuse angle with the central portion, each of said wings conforming to the respective side surface of the pockets, and anchored in a respective one of said pockets.

12. The tamper-resistant electrical receptacle of claim 11, wherein each shutter member has a recess adjacent a lower edge of said ramped surface, and a lower edge of the respective cover member has a hook member received in said recess.

13. The tamper-resistant electrical receptacle of claim 12, wherein each shutter member has at least one protrusion adjacent an upper edge of said ramped surface, and an upper edge of the respective cover member abuts said at least one protrusion.

14. The tamper-resistant electrical receptacle of claim 11, wherein the pockets of each shutter member extend laterally outward from the sides of said ramped surface.

15. The tamper-resistant electrical receptacle of claim 14, wherein each shutter member has a recess adjacent a lower edge of said ramped surface, and a lower edge of the respective cover member has a hook member received in said recess.

16. The tamper-resistant electrical receptacle of claim 15, wherein each shutter member has at least one protrusion adjacent an upper edge of said ramped surface, and an upper edge of the respective cover member abuts said at least one protrusion.

17. The tamper-resistant electrical receptacle of claim 14, wherein prior to connecting each cover member to its respective shutter member, distal ends of said wings are spaced apart by a first distance that is greater than a maximum distance between inwardly facing side surfaces of said pockets, and when connecting said cover member to said shutter member, said wings flex inward as they enter said pockets.

18. The tamper-resistant electrical receptacle of claim 17, wherein each shutter member has a recess adjacent a lower edge of said ramped surface, and a lower edge of the respective cover member has a hook member received in said recess when said wings are anchored in said pockets.

19. The tamper-resistant electrical receptacle of claim 18, wherein each shutter member has at least one protrusion adjacent an upper edge of said ramped surface, and an upper edge of the respective cover member abuts said at least one protrusion when said wings are anchored in said pockets.

20. The tamper-resistant electrical receptacle of claim 17, wherein said wings conform to said inwardly facing side surfaces of their respective pockets and snap into said pockets when fully received therein.

* * * * *